United States Patent [19]

Harrison

[11] Patent Number: 4,760,614

[45] Date of Patent: Aug. 2, 1988

[54] DRAINAGE PIPE STOPPAGE DISPLACER

[76] Inventor: C. L. Scott Harrison, 31 Riverside Dr., Wilmington, Del. 19809

[21] Appl. No.: 113,467

[22] Filed: Oct. 23, 1987

[51] Int. Cl.[4] ..... E03D 11/00

[52] U.S. Cl. ..... 4/255; 4/256; 4/661; 4/DIG. 9

[58] Field of Search ..... 4/255, 256, DIG. 9, 4/257, 661, 286; 134/22.12, 166 C; 285/9.2; 137/240

[56] References Cited

U.S. PATENT DOCUMENTS

| | | | |
|---|---|---|---|
| 1,232,767 | 7/1917 | Camfield et al. | 4/257 X |
| 1,660,121 | 2/1928 | Fetter | 4/256 X |
| 1,938,064 | 12/1933 | Carmine | 4/256 X |
| 3,936,892 | 2/1976 | Miller | 4/255 |

FOREIGN PATENT DOCUMENTS

| | | | |
|---|---|---|---|
| 24872 | of 1902 | United Kingdom | 4/256 |

*Primary Examiner*—Henry K. Artis
*Attorney, Agent, or Firm*—Abramo & Abramo

[57] ABSTRACT

A device for displacing or washing out blockages in pipe systems. The device has a central tube which can be closed with a gate valve which thereby isolates the pipe above and below the device. Fluid under pressure is introduced through a three way valve that can be positioned to direct the flow of fluid into the isolated chamber above the gate valve if that is where the blockage is or below the gate valve if the blockage is there.

8 Claims, 1 Drawing Sheet

DRAINAGE PIPE STOPPAGE DISPLACER

BACKGROUND OF THE INVENTION

The present invention relates to a device for displacing or breaking blockages that occur in plumbing systems or in any system employing pipes for the purpose of moving liquids and/or solids. The primary object of this invention is to provide a simple and effective means of applying fluid pressure to a blockage that might occur in a pipe.

A number of devices designed to remove blockages in drainpipes have been reported in the prior art. Miller, in U.S. Pat. No. 3,936,892 describes a device which is a y-shaped tube which is adapted to receive a hose which can deliver fluids under pressure to a plumbing system. This device is limited to directing pressure to blockages below the device. Canadian Pat. No. 482,593 to MacArthur is very similar to the Miller patent and provides for a device that applies pressure to a blockage below the described invention but does not provide for the application of pressure above the device. Holmes describes a device in U.S. Pat. No. 831,722, which provides for a hose being applied to a device in the side of the drainage pipe which also had a closure above the entrance way into the drainage pipe for the knocking down of blockages. Again, all blockages that are to be removed are located below the device mentioned in the application. There is no provision for pressure to be applied above the location where the claimed inventive device is attached to the plumbing systm. Strickland, in U.S. Pat. No. 798,713, describes an attachment at the lowest point of the U-shaped trap in a sink drainage system for directing a flow of water either to the right or to the left. This system involves usage of a pipe in the trap itself and it is not designed to attack blockages that may be located above the place where the pipe enters the plumbing system. This device is designed to apply a jet of water at the blockage to break the blockage into pieces rather than displace it from the position where it has formed. Schock, in U.S. Pat. No. 3,526,547, also describes the introduction of a wide tube into the trap of a sink for the purpose of knocking out blockages in the U-shape drainage trap. All of these devices suffer from the same defect in that they are not capable of being directed above the location of the invention. For the most part, they are concerned with knocking out blockages in the U-shape drain in sink traps and it is not clear how they would perform if the blockage was located some distance from the U-shaped trap.

SUMMARY OF THE INVENTION

The device is a means of displacing blockages that may appear in a system of pipes. Pressure is directed to blockages located above or below the place where the device is positioned. The device canbe attached to a system of pipes by cutting a section of pipes and attaching the two ends of the central tube to the two ends of the pipe system. From that position, it can displace blockages above and below the displacer. The device acts by directing the passage of a fluid under pressure, usually water or air, into the pipe system and against the blockage. The device operates by first closing a section of pipe a gate valve of the displacer and fluid is directed through a passage way either above or below the gate valve by means of a three-way valve. Fluid under pressure is introduced into the displacer through the three-way valve and then is directed above or below the closed gate valve, as desired, by positioning the three-way valve to direct fluid from an outside source into the system. The displacer can be fabricated from plastic or metal.

DETAILED DESCRIPTION OF THE PREFERRED EMBODIMENT

Figure 1:
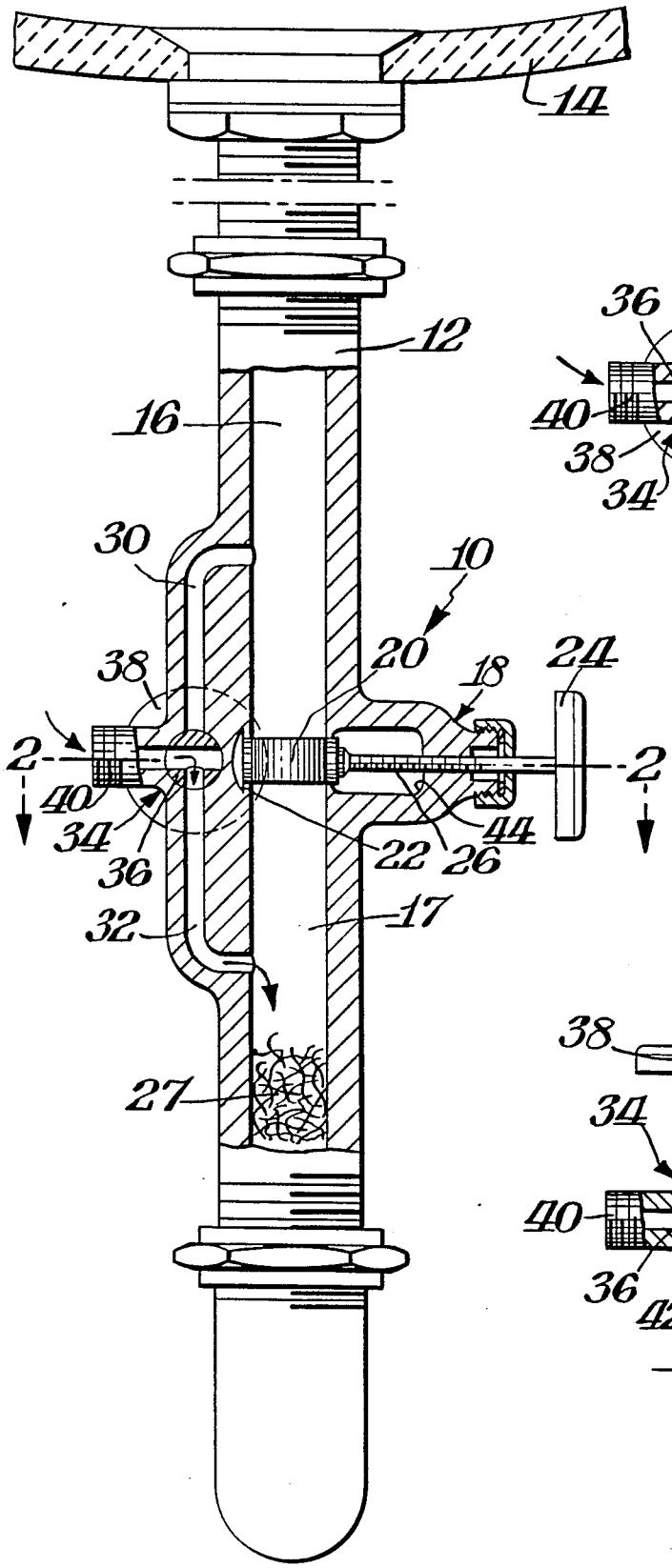
FIG. 1 is a front elevational view showing the displacer in cross-section with a blockage located below the invention.

Referring now to the drawings in detail: A drainage pipe stoppage displacer 10 is positioned in a pipe 12 attached to a plumbing appliance 14. FIG. 1 is not intended to suggest that the displacer 10 is located immediately next to a plumbing appliance. In fact the displacer 10 can be positioned anywhere in a system of pipes. For example, the device could be located in the basement of a building and thereby conveniently provide for the application of fluid pressure from the bottom of a blockage as suggested in FIG. 3 or to a blockage 2 located below it is as shown in FIG. 1. The displacer 10, has an upper drainage channel 16 and a lower drainage channel 17 which have a gate valve 18 between them in which the valve member 20 is shown in the closed position and engaging the valve seat 22 and thereby isolating the upper drainage channel 16 from the application of fluid under pressure. The valve member 20 is raised and lowered by means of the gate valve handle 24 which rotates the threaded valve shaft 26. The drainage channel 16 above the gate valve 18 connects to an upper fluid channel 32 which communicates with a three way valve 34.

The three way valve 34 has a three way connector 36 which is positioned by means of the handle 38. Fluid pressure is applied to the displacer 10 by connection of the end 40 to a source of fluid, usually air or water, under pressure. As shown in FIG. 1, the three way valve 34 is positioned so that the fluid applied through the end 40 will be directed through the three way connector 36 down the lower fluid channel 32 into the lower drainage channel 7 and against the blockage 27. Closing the gate valve 18 as shown in FIG. 1 prevents any fluid pressure from reaching into the upper drainage channel 16 above the gate valve 18 and thereby isolates the space above the blockage 27 from the rest of the pipe system and permits the fluid under pressure to be directed against the blockage 27.

Figure 3:
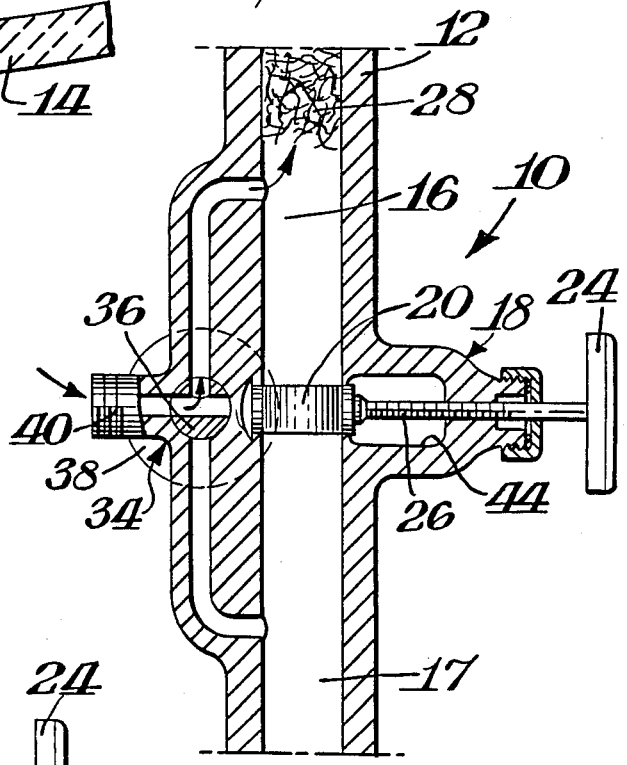
FIG. 2 is a cross-sectional plan view taken along line 2—2 of FIG. 1 showing the valve member in the valve seat when the valve is closed and FIG. 3 is a front elevational view showing the three way valve opened upward to displace a blockage located above the position of the displacer.

FIG. 3 shows the way the displacer 10 is positioned when a blockage 28 is shown on the other side of the displacer 10. The three way valve 36 is positioned to direct fluid into the upper drainage channel 17 so pressure can be directed against the blockage 27.

Figure 2:
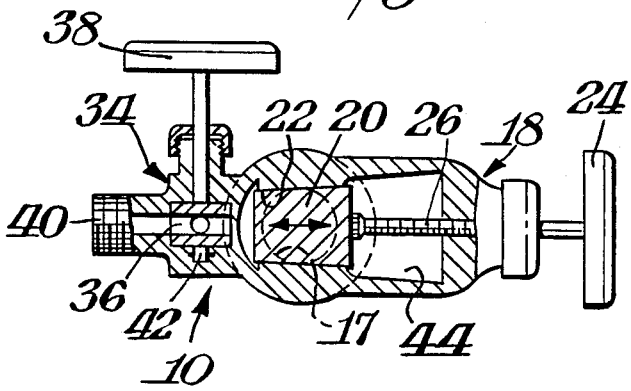

FIG. 2 shows the location of the valve seat 22 and the stub shaft 42 about which the three way connector 36 pivots and is positioned in FIG. 1.

It is apparent from the drawing that when the plumbing system has no blockages and is in normal use, the gate valve 20 will be recessed into chamber 44 so that liquid and/or solid matter can flow freely through the upper drain channel 16 and the lower drain channel 17.

As previously mentioned the invention can be positioned any where in the plumbing system and can be permanently mounted in the piping of the plumbing system.

In another embodiment, the displacer 10 can be kept out of the plumbing system until it is needed and then after removing a section of pipe, the displacer 10 can be attached by means of couplings to a blocked pipe and then the operator can direct fluid pressure above or below the device to displace and flush the blockage out of the system.

It will be appreciated that the device can be made of metal pipe or plastic pipe. The design shown in the figures could be molded plastic which would facilitate the manufacture of a compact design such as the one shown. However, the same configuration could be achieved using metal pipe and not depart from the scope of the invention.

While the device has been described in connection with a plumbing system, it is apparent that it could be used in any system that employs pipes to move fluids or solids from one location to another such as factories or plants that move slurries or finely divided solids by piping means and in ships or oil drilling platforms that have pipes that communicate with the sea and can be blocked by marine creatures or organisms.

I claim:

1. A device for removing blockage in a pipe system comprising a central tube attached at each end to the system; said central tube having an upper chamber and lower chamber and a gate valve positioned between the upper and lower chamber and having an open and closed position whereby the central tube can be closed when the gate valve is closed and thereby blocking the central tube; and upper and lower tube way each having two ends and being connected to and communicating through a three-way valve means connected to one of their ends and wherein the other end of the upper tube way is connected to and communicates with the upper chamber and the lower tube way is connected to and communicates with the lower chamber; and wherein the threeway valve has an external connector whereby fluid, under pressure can be directed into the three-way valve means and thereafter the three-way valve means can be positioned to direct fluid into either the upper or lower tube way such that when the gate valve is closed, fluid under pressure is directed toward blockages located above or below the device and displaces or washed them away so the system is opened.

2. A device as in claim 1 wherein the device is formed from plastic materials.

3. A device as in claim 1 wherein the device is made of metal.

4. The method of removing blockages in a pipe system which comprises operating a device having a central tube attached at each end to the pipe system; said central tube having an upper chamber and a lower chamber and a gate valve positioned between the upper and lower chamber and having an open and closed position whereby the central tube can be closed when the gate valve is closed and thereby blocking the central tube; an upper and lower tube way each having two ends and being connected to and communicating through a three-way valve means connected to one of their ends and wherein the other end of the upper tube way is connected to and communicates with the upper chamber and the lower tube way is connected to and communicated with the lower chamber; and wherein the three-way valve has an external connector whereby fluid, under pressure can be directed into the three-way valve means and thereafter the three-way valve means can be positioned to direct fluid into either the upper or lower tube way such that when the gate valve is closed, fluid under pressure is directed toward blockages located above or below the device and displaces them away so that the pipe system is opened.

5. The method according to claim 4 wherein the fluid is water.

6. The method according to claim 4 wherein the fluid is air.

7. The method according to claim 4 wherein the device is portable and is attached to the system just before use.

8. The method according to claim 4 wherein the system is a plumbing system.

* * * * *